US010191415B2

(12) United States Patent
Mizutani et al.

(10) Patent No.: US 10,191,415 B2
(45) Date of Patent: Jan. 29, 2019

(54) TRANSFER ROTATOR AND IMAGE FORMING APPARATUS COMPRISING THE SAME

(71) Applicants: Takehide Mizutani, Tokyo (JP); Naoto Kochi, Tokyo (JP); Katsuhito Haruno, Kanagawa (JP); Atsushi Nakamoto, Kanagawa (JP); Masakazu Imai, Kanagawa (JP); Osamu Ichihashi, Kanagawa (JP)

(72) Inventors: Takehide Mizutani, Tokyo (JP); Naoto Kochi, Tokyo (JP); Katsuhito Haruno, Kanagawa (JP); Atsushi Nakamoto, Kanagawa (JP); Masakazu Imai, Kanagawa (JP); Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/801,858

(22) Filed: Nov. 2, 2017

(65) Prior Publication Data

US 2018/0143570 A1 May 24, 2018

(30) Foreign Application Priority Data

Nov. 14, 2016 (JP) ..... 2016-221470

(51) Int. Cl.
*G03G 15/00* (2006.01)
*G03G 15/16* (2006.01)

(52) U.S. Cl.
CPC ..... *G03G 15/161* (2013.01); *G03G 15/50* (2013.01); *G03G 15/556* (2013.01); *G03G 2215/1661* (2013.01)

(58) Field of Classification Search
CPC ..... G03G 15/161; G03G 15/50
See application file for complete search history.

(56) References Cited

U.S. PATENT DOCUMENTS

| | | | | |
|---|---|---|---|---|
| 2010/0142985 | A1 | 6/2010 | Minbe et al. | |
| 2010/0221029 | A1 | 9/2010 | Minbu et al. | |
| 2011/0222885 | A1 * | 9/2011 | Yamaki | G03G 15/0131 399/66 |

(Continued)

FOREIGN PATENT DOCUMENTS

| | | |
|---|---|---|
| JP | 8-254873 | 10/1996 |
| JP | 2015-161941 | 9/2015 |
| JP | 2016-161667 | 9/2016 |

*Primary Examiner* — Rodney A Bonnette
(74) *Attorney, Agent, or Firm* — Oblon, McClelland, Maier & Neustadt, L.L.P.

(57) ABSTRACT

An image forming apparatus includes a developing device, an image bearer, a transfer rotator, a blade contacting a surface of the transfer rotator, and a controller to control the developing device, the image bearer, and the transfer rotator. A first toner pattern image is formed on the image bearer, transferred onto the transfer rotator, and passed past the blade at least twice together with rotation of the transfer rotator in at start-up of the image forming apparatus. A second toner pattern image is formed on the image bearer after the start-up and during passage of a non-image area in which toner images are not formed. A range of the first toner pattern image is wider than a range of the second toner pattern image in a width direction perpendicular to a direction of travel of the image bearer.

20 Claims, 7 Drawing Sheets

(56) References Cited

U.S. PATENT DOCUMENTS

| | | | | |
|---|---|---|---|---|
| 2011/0293307 | A1* | 12/2011 | Ogata | G03G 15/161 399/66 |
| 2013/0236201 | A1 | 9/2013 | Mizutani et al. | |
| 2016/0161887 | A1 | 6/2016 | Sugiura et al. | |
| 2016/0161888 | A1 | 6/2016 | Wada et al. | |
| 2016/0252864 | A1 | 9/2016 | Kamihara et al. | |
| 2017/0003623 | A1* | 1/2017 | Noguchi | G03G 15/161 |
| 2017/0003628 | A1* | 1/2017 | Fukazawa | G03G 15/161 |
| 2017/0185007 | A1 | 6/2017 | Kochi et al. | |

* cited by examiner

TRANSFER ROTATOR AND IMAGE FORMING APPARATUS COMPRISING THE SAME

CROSS-REFERENCE TO RELATED APPLICATION

This patent application is based on and claims priority pursuant to 35 U.S.C. § 119(a) to Japanese Patent Application No. 2016-221470, filed on Nov. 14, 2016, in the Japan Patent Office, the entire disclosure of which is hereby incorporated by reference herein.

BACKGROUND

Technical Field

This disclosure generally relates to an image forming apparatus such as a copier, a facsimile machine, a printer, or a multifunction peripheral (MFP) having at least two of copying, printing, facsimile transmission, plotting, and scanning capabilities.

Related Art

Image forming apparatuses such as copiers and printers generally include a transfer rotator such as a secondary transfer belt or a secondary transfer roller to press against an image bearer such as an intermediate transfer belt. The transfer rotator contacts the image bearer to form a transfer nip. In addition, the image forming apparatuses include a blade configured to clean a surface of the transfer rotator.

Specifically, in the image forming apparatus, a plurality of developing devices develop respective toner images on a plurality of photoconductors. The toner images on the plurality of photoconductors are primarily transferred and superimposed onto a surface of the intermediate transfer belt one on another to form a multicolor toner image. The multicolor toner image on the intermediate transfer belt is then secondarily transferred onto a recording medium transported to a secondary transfer nip. The recording medium, onto which the multicolor toner image is secondarily transferred, is transported on the secondary transfer belt and separated from the secondary transfer belt by a separation roller, around which the secondary transfer belt is looped. Then, the recording medium is transported toward a fixing device to fix the toner image on the recording medium.

The secondary transfer belt looped around a secondary transfer roller and the intermediate transfer belt looped around a secondary-transfer backup roller are interposed between the secondary transfer roller and the secondary-transfer backup roller to form the secondary transfer nip. The secondary transfer belt is also referred to as a nip-forming belt. A secondary transfer cleaning blade is disposed in contact with the secondary transfer roller via the secondary transfer belt to remove substances, such as toner and paper dust adhering to the secondary transfer belt.

A certain amount of toner in a developing device is compulsorily discharged before toner degradation to maintain the quality of the toner image. Specifically, the developing device develops a compulsory consumption toner image on a surface of the photoconductor at an interval between successive recording media to refresh toner in the developing device.

SUMMARY

According to an embodiment of this disclosure, an improved image forming apparatus includes a developing device to develop a toner image, an image bearer to bear the toner image developed by the developing device, a transfer rotator to transfer the toner image onto a recording medium at a transfer nip formed between the image bearer and the transfer rotator, a blade contacting a surface of the transfer rotator, and a controller that controls the developing device, the image bearer, and the transfer rotator. A first toner pattern image is formed on the image bearer, transferred onto the transfer rotator, and passed past the blade at least twice together with rotation of the transfer rotator during start-up of the image forming apparatus. A second toner pattern image is formed on the image bearer after the start-up and during passage of a non-image area in which toner image is not formed on the image bearer. A range of the first toner pattern image is wider than a range of the second toner pattern image in a width direction perpendicular to a direction of travel of the image bearer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
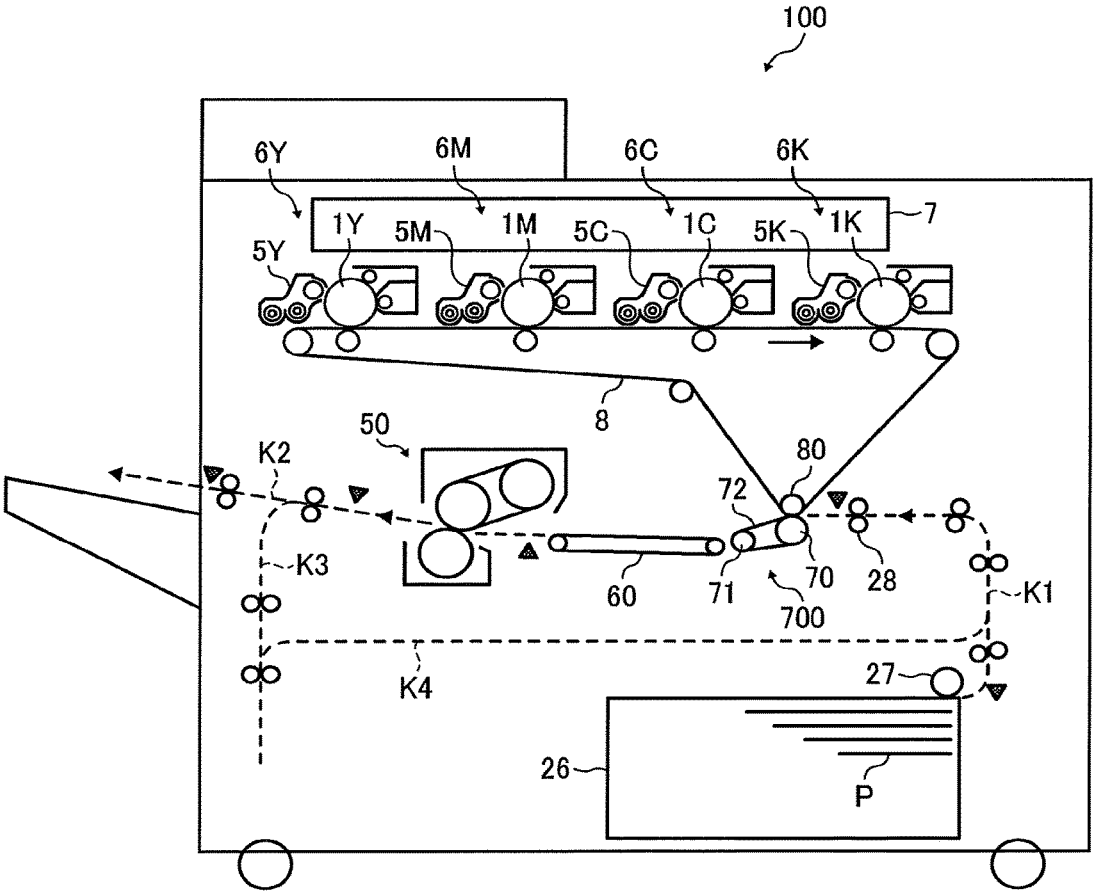
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, and particularly to FIG. 1, an image forming apparatus according to embodiments of the present disclosure is described, and redundant descriptions are omitted or simplified below. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
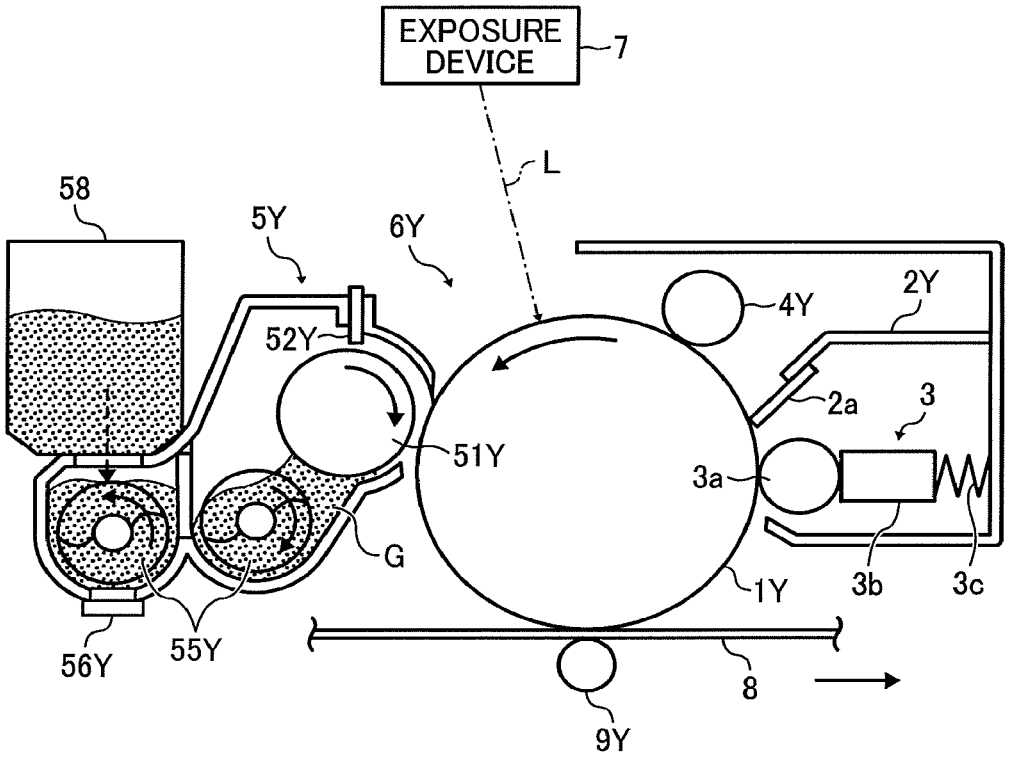
FIG. 2 is a schematic diagram illustrating an image forming unit of the image forming apparatus according to an embodiment of the present disclosure.

Referring to FIGS. 1 and 2, a configuration and operations of an image forming apparatus 100 according to the present embodiment is described below.

FIG. 1 is a schematic diagram of the image forming apparatus 100, which in the present embodiment is a printer. FIG. 2 is a schematic diagram of an image forming unit 6Y of the image forming apparatus 100 illustrated in FIG. 1.

As illustrated in FIG. 1, the image forming apparatus 100 includes an intermediate transfer belt 8 as an image bearer and an intermediate transferor in a center of the apparatus body. The image forming units 6Y, 6M, 6C, and 6K respectively corresponding to yellow, magenta, cyan, and black are arranged side by side, facing the intermediate transfer belt 8.

Referring to FIG. 2, the image forming unit 6Y for yellow includes a photoconductor drum 1Y as a photoconductor and a charger 4Y, a developing device 5Y, a cleaning device 2Y, a lubricant applicator 3, a discharger, and the like provided around the photoconductor drum 1Y. Image forming processes, namely, charging, exposure, development, transfer, and cleaning processes are performed on the photoconductor drum 1Y, and thus a yellow toner image is formed on the photoconductor drum 1Y.

The other image forming units 6M, 6C, and 6K have a similar configuration to that of the yellow image forming unit 6Y except for the color of the toner used therein and form magenta, cyan, and black toner images, respectively. Thus, only the image forming unit 6Y is described below and descriptions of the other image forming units 6M, 6C, and 6K are omitted.

Referring to FIG. 2, the photoconductor drum 1Y is rotated counterclockwise in FIG. 2 by a motor. The charger 4Y uniformly charges a surface of the photoconductor drum 1Y at a position opposite the charger 4Y (charging process).

Then, the charged surface of the photoconductor drum 1Y reaches a position to receive a laser beam L from an exposure device 7, getting exposed to scanning in a width direction, thus forming an electrostatic latent image of yellow at the position (exposure process). The width direction is a main-scanning direction perpendicular to the drawing sheet of FIGS. 1 and 2.

The surface of the photoconductor drum 1Y bearing the electrostatic latent image reaches a position facing the developing device 5Y, and the electrostatic latent image is developed into a toner image of yellow at the position (developing process).

When the surface of the photoconductor drum 1Y bearing the toner image reaches a position opposite a primary transfer roller 9Y via the intermediate transfer belt 8, and the toner image is transferred from the photoconductor drum 1Y onto a surface of the intermediate transfer belt 8 at the position (primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (cleaning process).

The cleaning device 2Y includes a lubricant supply roller 3*a*, a solid lubricant 3*b*, and a compression spring 3*c* as a pressing member, which constitute a lubricant applicator 3 for the photoconductor drum 1Y. The lubricant supply roller 3*a* rotating clockwise in FIG. 2 rubs a small amount of lubricant from the solid lubricant 3*b* and applies the lubricant to the surface of the photoconductor drum 1Y.

Subsequently, the surface of the photoconductor drum 1Y reaches a position facing the discharger, and the discharger removes residual potentials from the photoconductor drum 1Y.

Thus, a sequence of image forming processes performed on the photoconductor drum 1Y is completed.

The above-described image forming processes are performed in the image forming units 6M, 6C, and 6K similar to the yellow image forming unit 6Y. That is, the exposure device 7 disposed above the image forming units 6M, 6C, and 6K irradiates the photoconductor drums 1M, 1C, and 1K of the image forming units 6M, 6C, and 6K with the laser beam L based on image data. Specifically, the exposure device 7 includes a light source to emit the laser beams L, multiple optical elements, and a polygon mirror that is rotated by a motor. The exposure device 7 directs the laser beams L to the photoconductor drums 1M, 1C, and 1K via the multiple optical elements while deflecting the laser beams L with the polygon mirror. An exposure device 7 in which a plurality of light emitting diodes (LED) is arranged side by side in the width direction can be used.

Then, the toner images formed on the photoconductor drums 1M, 1C, and 1K through the development process of the developing devices 5M, 5C, and 5K are transferred therefrom and superimposed one on another on the intermediate transfer belt 8. Thus, a multicolor toner image is formed on the intermediate transfer belt 8.

Figure 3:
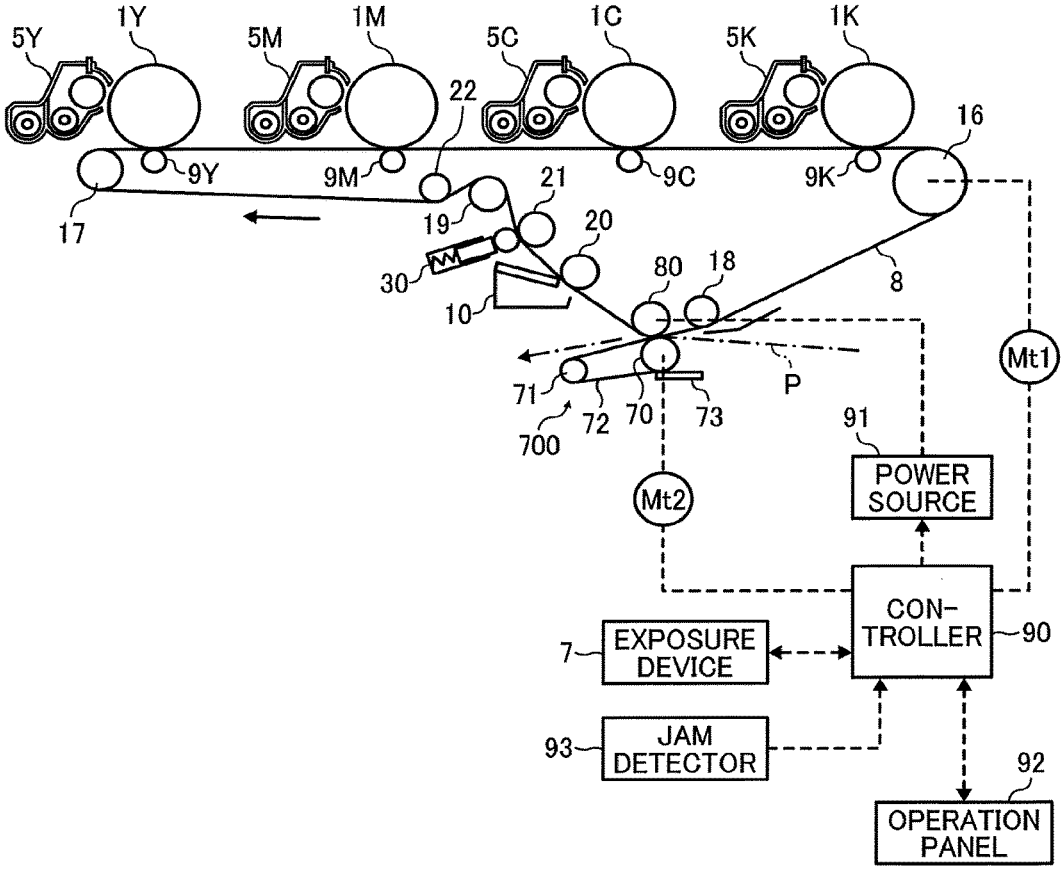
FIG. 3 is a schematic view of an intermediate transfer belt device and environs according to an embodiment of the present disclosure.

Referring now to FIG. 3, which is a schematic view of an intermediate transfer device, it can be seen that the intermediate transfer device includes the intermediate transfer belt 8 (intermediate transferor), four primary transfer rollers 9Y, 9M, 9C, and 9K, a drive roller 16, a driven rollers 17, a pre-transfer roller 18, a tension roller 19, a cleaning backup roller 20, a lubricant backup roller 21, a backup roller 22, a belt cleaner 10, a lubricant applicator 30 for the intermediate transfer belt 8, a secondary-transfer backup roller 80, a secondary transfer device 700, and the like. The secondary transfer device 700 includes a secondary transfer roller 70, a separation roller 71, a secondary transfer belt 72, and a secondary-transfer cleaning blade 73. The intermediate transfer belt 8 is stretched taut around a plurality of rollers 16 through 22 and 80, and is endlessly rotated clockwise in FIG. 3 by the drive roller 16 driven by a drive motor Mt1.

The four primary transfer rollers 9Y, 9M, 9C, and 9K are pressed against the corresponding photoconductor drums 1Y, 1M, 1C, and 1K respectively via the intermediate transfer belt 8 to form primary transfer nips. A primary transfer bias opposite in polarity to toner is applied to the primary transfer rollers 9Y, 9M, 9C, and 9K.

While rotating in the direction indicated by the arrow in FIG. 3, the intermediate transfer belt 8 sequentially passes past the primary transfer nips between the photoconductor drums 1Y, 1M, 1C, and 1K and the respective primary transfer rollers 9Y, 9M, 9C, and 9K. Then, the single-color toner images on the photoconductor drums 1Y, 1M, 1C, and 1K are primarily transferred and superimposed one on another onto the intermediate transfer belt 8 (primary transfer process).

Then, the intermediate transfer belt 8 bearing the multicolor toner image reaches a position facing the secondary transfer belt 72 as a transfer rotator. The secondary-transfer backup roller 80 and the secondary transfer roller 70 press against each other via the intermediate transfer belt 8 and the secondary transfer belt 72, and the contact portion therebetween is hereinafter referred to as a secondary transfer nip. The multicolor (four-color) toner image on the intermediate transfer belt 8 is transferred onto a recording sheet P as a recording medium transported to the secondary transfer nip. At that time, a certain amount of toner tends to remain untransferred on the intermediate transfer belt 8 after the secondary transfer process.

Then, the intermediate transfer belt 8 reaches a position facing the belt cleaner 10. Adhered substances remaining on the surface of the intermediate transfer belt 8 such as the untransferred toner are collected by the belt cleaner 10.

Subsequently, the surface of the intermediate transfer belt 8 reaches a position facing the lubricant applicator 30 for the intermediate transfer belt 8. Lubricant is applied to the surface of the intermediate transfer belt 8 by the lubricant applicator 30 at the position.

Thus, a sequence of image transfer processes performed on the intermediate transfer belt 8 is completed.

Meanwhile, referring back to FIG. 1, the recording sheet P is transported from a sheet feeder 26 provided in a lower portion of the body of the image forming apparatus 100 to the secondary transfer nip via a sheet feeding roller 27 and a registration roller pair 28.

More specifically, the sheet feeder 26 contains multiple recording sheets P piled one on another. As the sheet feeding roller 27 rotates counterclockwise in FIG. 1, the top sheet of the recording sheets P in the sheet feeder 26 is fed toward a nip between the registration roller pair 28 via a first conveyance path K1.

The registration roller pair 28 (timing roller pair) stops rotating temporarily, stopping the recording sheet P with a leading edge of the recording sheet P nipped in the registration roller pair 28. The registration roller pair 28 rotates to transport the recording sheet P to the secondary transfer nip, timed to coincide with the arrival of the multicolor toner image on the intermediate transfer belt 8. Thus, the multicolor toner image is transferred onto the recording sheet P.

The recording sheet P, onto which the multicolor toner image is secondarily transferred, is carried on the secondary transfer belt 72 and separated from the secondary transfer belt 72. Then, the recording sheet P is transported toward a fixing device 50 by a conveyance belt 60. In the fixing device 50, a fixing belt and a pressing roller apply heat and pressure to the recording sheet P to fix the multicolor toner image on the recording sheet P (fixing process).

Subsequently, the recording sheet P is transported through a second conveyance path K2 and discharged by a discharge roller pair outside the image forming apparatus 100. The recording sheets P are sequentially stacked as output images on a stack tray.

Thus, a sequence of image forming processes performed in the image forming apparatus 100 is completed.

Thus, in single-side printing, the recording sheet P is discharged after the toner image is fixed on the front side thereof. By contrast, in duplex printing to form toner images on both sides (front side and back side) of the recording sheet P, the recording sheet P is guided to a third conveyance path K3. After a direction of conveyance in which the recording sheet P is transported is reversed, the recording sheet P is transported again to the secondary transfer nip (secondary transfer device 700) via a fourth conveyance path K4. Then, through the image forming processes similar to those described above, the toner image is formed on the back side of the recording sheet P and fixed thereon by the fixing device 50, after which the recording sheet P is discharged from the image forming apparatus 100 via the second conveyance path K2.

Next, a detailed description is provided of a configuration and operations of the developing device 5Y referring to FIG. 2.

The developing device 5Y includes a developing roller 51Y disposed facing the photoconductor drum 1Y, two conveying screws 55Y disposed within the developing device 5Y, a doctor blade 52Y opposed to the developing roller 51Y, and a toner concentration detector 56Y to detect a toner concentration. The developing roller 51Y includes stationary magnets, a sleeve that rotates around the magnets, and the like. A developer container contain two-component developer G including carrier (carrier particles) and toner (toner particles).

The developing device 5Y with such a configuration operates as follows.

The sleeve of the developing roller 51Y rotates clockwise in FIG. 2. The developer G is carried on the developing roller 51Y by a magnetic field generated by the magnets. As the sleeve rotates, the developer G moves along a circumference of the developing roller 51Y. A ratio of toner to carrier (i.e., toner concentration) in the developer G contained in the developing device 5Y is adjusted to be within a predetermined range. Specifically, when the toner concentration detected by the toner concentration detector 56Y disposed in the developing device 5Y is low, fresh toner is supplied from a toner container 58 to the interior of the developing device 5Y to keep the toner concentration within the predetermined range.

The two conveying screws 55Y stirs and mixes the developer G with the toner added to the developer container while circulating the developer in the developer container that is separated into two parts. In this case, the developer moves in a direction perpendicular to the drawing sheet of FIG. 2. The toner in developer G is charged by friction with the carrier and electrostatically attracted to the carrier. Then, the toner is carried on the developing roller 51Y together with the carrier by a magnetic force generated on the developing roller 51Y.

The developer G carried on the developing roller 51Y is transported in the clockwise direction in FIG. 2 to the doctor blade 52Y. The amount of developer G on the developing roller 51Y is adjusted by the doctor blade 52Y, after which the developer G is carried to a developing range facing the photoconductor drum 1Y. Then, the toner in the developer G adsorbs to the electrostatic latent image formed on the photoconductor drum 1Y due to the effect of an electric field generated in the developing range. As the sleeve rotates, the developer G remaining on the developing roller 51Y reaches an upper part of the developer container and drops from the developing roller 51Y.

The toner container 58 is detachably attachable (replaceable) relative to the developing device 5Y (image forming apparatus 100). When the toner container 58 runs out of fresh toner, the toner container 58 is detached from the developing device 5Y (image forming apparatus 100) and replaced with a new one.

Next, a more detailed description is provided of the intermediate transfer device according to the present embodiment, referring to FIG. 3.

Referring now to FIG. 3, it can be seen that the intermediate transfer device includes the intermediate transfer belt 8 as the intermediate transferor, four primary transfer rollers 9Y, 9M, 9C, and 9K, a drive roller 16, a driven rollers 17, a pre-transfer roller 18, a tension roller 19, a cleaning backup roller 20, a lubricant backup roller 21, a backup roller 22, a belt cleaner 10 for the intermediate transfer belt 8, a lubricant applicator 30 for the intermediate transfer belt 8, a secondary-transfer backup roller 80, the secondary transfer device 700, and the like.

The intermediate transfer belt 8 is disposed in contact with the photoconductor drums 1Y, 1M, 1C, and 1K bearing the toner images of the respective colors to form the primary transfer nips. The intermediate transfer belt 8 is stretched taut around and supported by eight rollers: the drive roller 16, the driven roller 17, the pre-transfer roller 18, the tension roller 19, the cleaning backup roller 20, the lubricant backup roller 21, the backup roller 22, and the secondary-transfer backup roller 80.

According to the present embodiment, the intermediate transfer belt 8 includes a single layer or multiple layers including, but not limited to, polyimide (PI), polyvinylidene fluoride (PVDF), ethylene-tetrafluoroethylene copolymer (ETFE), and polycarbonate (PC), with conductive material such as carbon black dispersed therein. The volume resistivity of the intermediate transfer belt 8 is adjusted to a range from $10^6$ Ωcm to $10^{13}$ Ωcm, and the surface resistivity of the back surface of belt is adjusted to a range from $10^7$ Ω/sq to $10^{13}$ Ω/sq. The thickness of the intermediate transfer belt 8 ranges from 20 to 200 μm. According to the present embodiment, the intermediate transfer belt 8 has a thickness of 60 μm, and a volume resistivity of $10^9$ Ωcm.

In some embodiments, the intermediate transfer belt 8 may include a release layer on the surface of the intermediate transfer belt 8. The release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The primary transfer rollers 9Y, 9M, 9C, and 9K are disposed in contact with the photoconductor drums 1Y, 1M, 1C, and 1K (hereinafter also collectively referred to as "photoconductor drums 1"), respectively via the intermediate transfer belt 8. Specifically, the primary transfer roller 9Y for yellow is disposed in contact with the photoconductor drum 1Y for yellow via the intermediate transfer belt 8. The primary transfer roller 9M for magenta is disposed in contact with the photoconductor drum 1M for magenta via the intermediate transfer belt 8. The primary transfer roller 9C for cyan is disposed in contact with the photoconductor drum 1C for cyan via the intermediate transfer belt 8. The primary transfer roller 9K for black is disposed in contact with the photoconductor drum 1K for black via the intermediate transfer belt 8. Each of the primary transfer rollers 9Y, 9M, 9C, and 9K is an elastic roller including a core metal with a diameter of 10 mm and a conductive foamed layer with an outer diameter of 16 mm on the core metal. The volume resistivity of each of the primary transfer rollers 9Y, 9M, 9C, and 9K ranges from $10^6$ Ωcm to $10^{12}$ Ωcm, preferably from $10^7$ Ωcm to $10^9$ Ωcm.

The drive roller 16 is disposed in contact with an inner face of the intermediate transfer belt 8 by an angle of belt winding of 120 degrees at a position downstream from the four photoconductor drums 1 in a direction of travel of the intermediate transfer belt 8. The drive roller 16 is rotated clockwise in FIG. 3 by the drive motor Mt1, which is controlled by a controller 90. Such a configuration allows the intermediate transfer belt 8 to travel in a predetermined direction (i.e., clockwise in FIG. 3).

The driven roller 17 is disposed in contact with the inner face of the intermediate transfer belt 8 by the angle of belt winding of 180 degrees at a position upstream from the four photoconductor drums 1 in the direction of travel of the intermediate transfer belt 8. A portion of the intermediate transfer belt 8 from the driven roller 17 to the drive roller 16 is arranged approximately horizontal. The driven roller 17 is rotated clockwise in FIG. 3 as the intermediate transfer belt 8 travels.

The tension roller 19 contacts an outer circumferential surface of the intermediate transfer belt 8. The pre-transfer roller 18, the cleaning backup roller 20, the lubricant backup roller 21, the backup roller 22, and the secondary-transfer backup roller 80 contact the inner face of the intermediate transfer belt 8.

Between the secondary-transfer backup roller 80 and the lubricant backup roller 21 is disposed the belt cleaner 10 (cleaning blade), which contacts the cleaning backup roller 20 via the intermediate transfer belt 8.

Between the cleaning backup roller 20 and the tension roller 19 is disposed the lubricant applicator 30, which contacts the lubricant backup roller 21 via the intermediate transfer belt 8. Similar to the lubricant applicator 3 for the photoconductor drums 1, the lubricant applicator 30 includes a lubricant supply roller, a solid lubricant, and a compression spring as a pressing member for the intermediate transfer belt 8. The lubricant supply roller rotating counterclockwise in FIG. 3 rubs a small amount of lubricant from the solid lubricant and applies the lubricant to the surface of the intermediate transfer belt 8.

The plurality of rollers 17 through 22 and 80 other than the drive roller 16 is rotated clockwise in FIG. 3 by the intermediate transfer belt 8.

Referring again to FIG. 3, the secondary-transfer backup roller 80 contacts the secondary transfer roller 70 via the intermediate transfer belt 8 and the secondary transfer belt 72. The secondary-transfer backup roller 80 includes a cylindrical core metal made of stainless steel having an elastic layer on the outer circumferential surface of the core metal. The elastic layer is made of Acrylonitrile-Butadiene Rubber (NBR). The elastic layer has the volume resistivity ranging from approximately $10^7$ Ωcm to $10^8$ Ωcm, and a hardness ranging from approximately 48° to 58° on Japanese Industrial Standards (hereinafter, referred to as JIS)-A hardness scale. The elastic layer has a thickness of approximately 5 mm.

According to the present embodiment, the secondary-transfer backup roller 80 is electrically connected to a power source 91 as a bias output device, which outputs a high voltage of −5 kV as a secondary transfer bias. With the secondary transfer bias output to the secondary-transfer backup roller 80, the toner image primarily transferred to the surface of the intermediate transfer belt 8 is secondarily transferred onto the recording sheet P transported to the secondary transfer nip. The secondary transfer bias has the same polarity as the polarity of the toner. In the present embodiment, the secondary transfer bias is direct current voltage and has a negative polarity. With this configuration, the toner borne on the outer circumferential surface (toner bearing surface) of the intermediate transfer belt 8 electrostatically moves from the secondary-transfer backup roller 80 side toward the secondary transfer device 700.

Figure 4A:
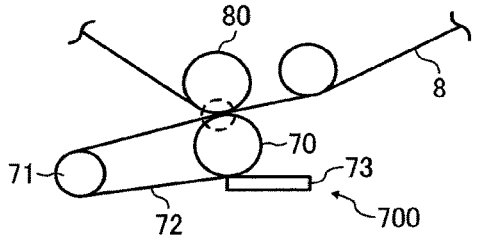
FIG. 4A is a schematic diagram illustrating the intermediate transfer belt and a secondary transfer device contacting each other according to an embodiment of the present disclosure.

Referring to FIGS. 3 and 4A, it can be seen that the secondary transfer device 700 includes the secondary transfer belt 72 as the transfer rotator, the secondary transfer roller 70, the separation roller 71, and the secondary-transfer cleaning blade 73 as a blade. In the present embodiment, the secondary transfer device 700 does not include a lubricant applicator to directly apply lubricant to a surface of the secondary transfer belt 72. Accordingly, the device secondary transfer alleviates cost increase, size increase, and weight increase.

The secondary transfer belt 72 is an endless belt stretched taut around the secondary transfer roller 70 and the separation roller 71. The secondary transfer belt 72 is made of a material similar to that for the intermediate transfer belt 8. The secondary transfer belt 72 contacts the intermediate transfer belt 8 to form the secondary transfer nip indicated by the broken-line circle in FIG. 4A and transports the recording sheet P fed from the secondary transfer nip.

The secondary-transfer backup roller 80 and the secondary transfer roller 70 press against each other via the intermediate transfer belt 8 and the secondary transfer belt 72 to form the secondary transfer nip. The secondary transfer roller 70 includes a hollow core metal made of stainless steel or aluminum and an elastic layer (coating) on the core metal. The elastic layer has a hardness ranging approximately from 40° through 50° on Asker C hardness scale. To form the elastic layer of the secondary transfer roller 70, for example, a rubber material, such as polyurethane, ethylene-propylene-diene monomer (EPDM), and silicone, is formed into a solid or foamed state as follows. A conductive filler, such as carbon, is dispersed in the rubber material. Alternatively, an ionic conductive material is included in the rubber material. According to the present embodiment, the elastic layer of the secondary transfer roller 70 has the volume resistivity ranging from $10^{6.5}$ Ωcm to $10^{7.5}$ Ωcm to prevent concentration of the transfer electrical current. Further, the secondary transfer roller 70 is electrically grounded.

As the secondary transfer roller 70 is rotated counterclockwise in FIG. 3 by a secondary drive motor Mt2 controlled with the controller 90, the secondary transfer belt 72 and the separation roller 71 is rotated counterclockwise in FIG. 3.

The separation roller 71 is disposed downstream from the secondary transfer nip in the direction of conveyance of the recording sheet P. Discharged from the secondary transfer nip, the recording sheet P is transported along the secondary transfer belt 72 rotating counterclockwise in FIG. 3 and separated from the secondary transfer belt 72 at a curved portion of the secondary transfer belt 72 wound around a circumference of the separation roller 71 by self-stripping.

In the present embodiment, the secondary transfer belt 72 is stretched taut around the secondary transfer roller 70 and the separation roller 71. Alternatively, in another embodiment, the secondary transfer belt 72 is stretched taut around more than two rollers.

Figure 7:
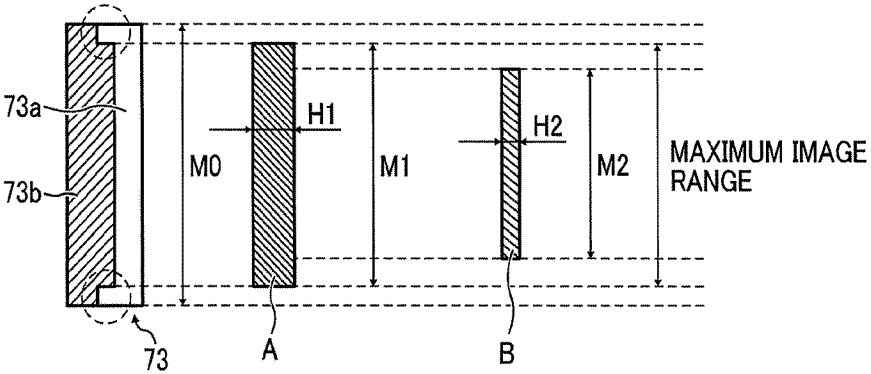
FIG. 7 is a diagram illustrating the relative positions in a width direction of a second transfer blade, a first toner pattern image, and a second toner pattern image according to an embodiment of the present disclosure.

The secondary-transfer cleaning blade 73 contacts the surface of the secondary transfer belt 72 to remove substances such as toner and paper dust adhering to the surface of the secondary transfer belt 72. The secondary-transfer cleaning blade 73 is pressed against the secondary transfer roller 70 via the secondary transfer belt 72 against the direction of travel of the secondary transfer belt 72. Referring to FIG. 7, the secondary-transfer cleaning blade 73 includes a plate-shaped blade body 73*a* made of rubber such as urethane rubber with thickness of 1 to 5 mm and a blade holder 73*b* made of metal plate to support the blade body 73*a*.

Figure 4B:
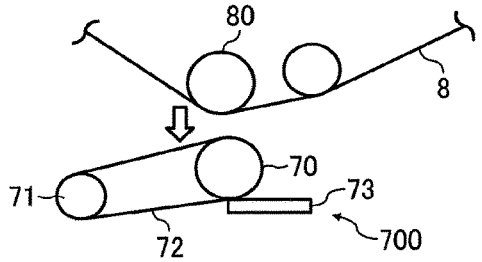
FIG. 4B is a schematic diagram illustrating the intermediate transfer belt and a secondary transfer device separating from each other according to an embodiment of the present disclosure.

As illustrated in FIGS. 4A and 4B, in the present embodiment, the image forming apparatus includes a contact-separation mechanism that enables the secondary transfer device 700 to contact and separate from the intermediate transfer belt 8.

Specifically, as the secondary transfer roller 70 is displaced up or down by a cam disposed on the shaft of the secondary-transfer backup roller 80, the secondary transfer device 700 contacts and separates from the intermediate transfer belt 8.

In a usual image forming operation including timings before and after the operation and intervals between recording sheets P or start-up of the image forming apparatus to be described later, the secondary transfer device 700 contacts the intermediate transfer belt 8 as illustrated in FIG. 4A.

On the other hand, when the recording sheet P jamming in the conveyance paths K1 through K4 is removed, the secondary transfer device 700 separates from the intermediate transfer belt 8 as illustrated in FIG. 4B.

Figure 5A:
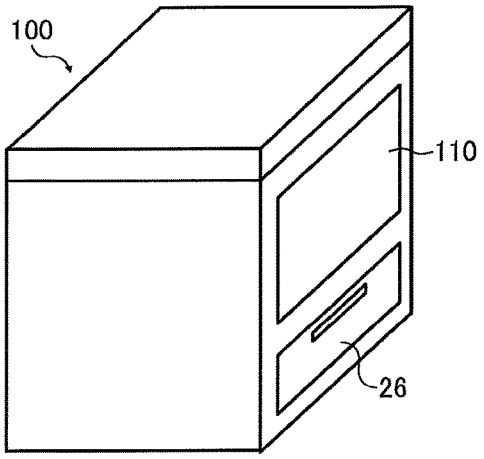
FIG. 5A is a schematic perspective view illustrating the image forming apparatus with a cover shut according to an embodiment of the present disclosure.
Figure 5B:
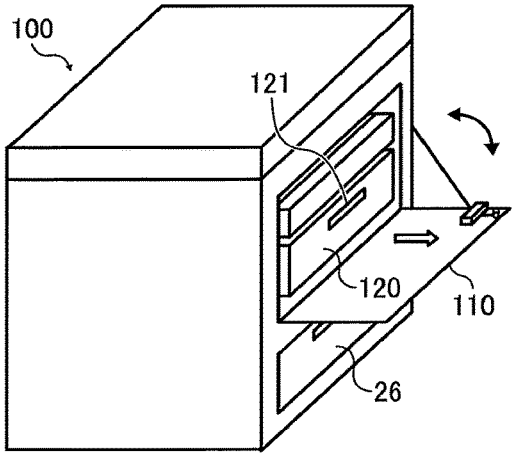
FIG. 5B is a schematic perspective view illustrating the image forming apparatus with a cover open according to an embodiment of the present disclosure.

Specifically, a user operates the image forming apparatus 100 according to operating procedures displayed on a control panel 92 of the image forming apparatus 100. Firstly, as a cover 110 opens, a drawer unit 120 appears. That is, the image forming apparatus 100 changes from a closed state illustrated in FIG. 5A to an opened state illustrated in FIG. 5B. Then, the user pulls the drawer unit 120 out by taking hold of a handle 121 of the drawer unit 120 in a direction along slide rails indicated by an open arrow in FIG. 5B from the body of the image forming apparatus 100 and removes jamming recording sheets P. Note that, in the present embodiment, the intermediate transfer device including the secondary transfer device 700, the registration roller pair 28, the fixing device 50, and the like are mounted on the drawer unit 120.

At that time, a photo sensor disposed on an inner wall of the handle 121 detects a state of grasping the handle 121, and the cam is controlled to move the secondary transfer device 700 from a contact state illustrated in FIG. 4A to a separation state illustrated in FIG. 4B automatically. After the jam (recording medium jam) has been cleared, as the drawer unit 120 is pushed and inserted into the body of the image forming apparatus 100, an operation opposite to the drawing is performed, the cam is controlled to move the secondary transfer device 700 from the separation state illustrated in FIG. 4B to the contact state illustrated in FIG. 4A automatically.

Next, referring to FIGS. 3 to 8, the configuration and operations of the image forming apparatus 100 according to the present embodiment are described in further detail below.

As described in FIG. 3, the image forming apparatus 100 includes the plurality of photoconductor drums 1 (1Y, 1M, 1C, and 1K), the plurality of the developing devices 5Y, 5M, 5C, and 5K (hereinafter also collectively referred to as "developing devices 5"), the intermediate transfer belt 8 as the image bearer, the secondary transfer belt 72 as the transfer rotator, the secondary-transfer cleaning blade 73, and the like.

The developing devices 5 develop toner images. Specifically, the plurality of developing devices 5 contains respective toner and develops respective toner images on the surface of the plurality of photoconductor drums 1.

The toner images developed by the developing devices 5 are formed on the intermediate transfer belt 8 as the image bearer. Specifically, the toner images on the plurality of photoconductor drums 1 are primarily transferred onto the surface of the intermediate transfer belt 8 one on another to form the multicolor toner image.

The secondary transfer belt 72 as the transfer rotator contacts the intermediate transfer belt 8 to form the secondary transfer nip to secondarily transfer the multicolor toner image from the surface of the intermediate transfer belt 8 onto the recording sheet P transported to the secondary transfer nip.

The secondary-transfer cleaning blade 73 contacts the surface of the secondary transfer belt 72 to remove the substances such as toner and paper dust adhering to the surface of the secondary transfer belt 72.

In the present embodiment, toner contained in the developing devices 5 is partly replaced with new toner based on a predetermined condition in order to prevent image failure due to degradation of toner (for example, spent carrier).

Specifically, referring to FIGS. 6 and 7, when toner images X having a predetermined image area rate (for example 1.5%) are successively formed on a plurality of recording sheets P beyond a predetermined number of recording sheets P, second toner pattern images B1 to B3 (hereinafter also collectively referred to as "second toner pattern images B") are formed in the image forming process described above. Differently from the toner image X formed in image areas, the second toner pattern images B are toner refreshment patterns formed in non-image areas such as an area corresponding to an interval between recording sheets P (i.e., sheet interval area). When the toner images X with low image area rate are successively formed, toner contained in the developing devices 5 are circulated in a state in which new toner is hardly supplied from the toner container 58 into the developing devices 5. Thus, repetition of collisions among careers and toner causes degradation of toner. In such a situation, the second toner pattern images B are formed to forcibly discharge degraded toner from the developing devices 5, and fresh toner is supplied from the toner container 58 to replace discharged degraded toner. Accordingly, the occurrence of image failure caused by degradation of toner over time is prevented, and favorable images can be obtained.

The image area rate of toner image X formed on the image area is obtained based on image data from the exposure device 7 by a central processing unit (CPU) of the controller 90. The number of recording sheets P (the number of formations of toner image X) is obtained based on data from the control panel 92 or a counter by central processing unit (CPU) of the controller 90. The controller 90 determines an image formation timing for the second toner pattern images B based on above-mentioned data and controls the image forming units 6Y, 6M, 6C, and 6K based on the determined result.

Figure 6:
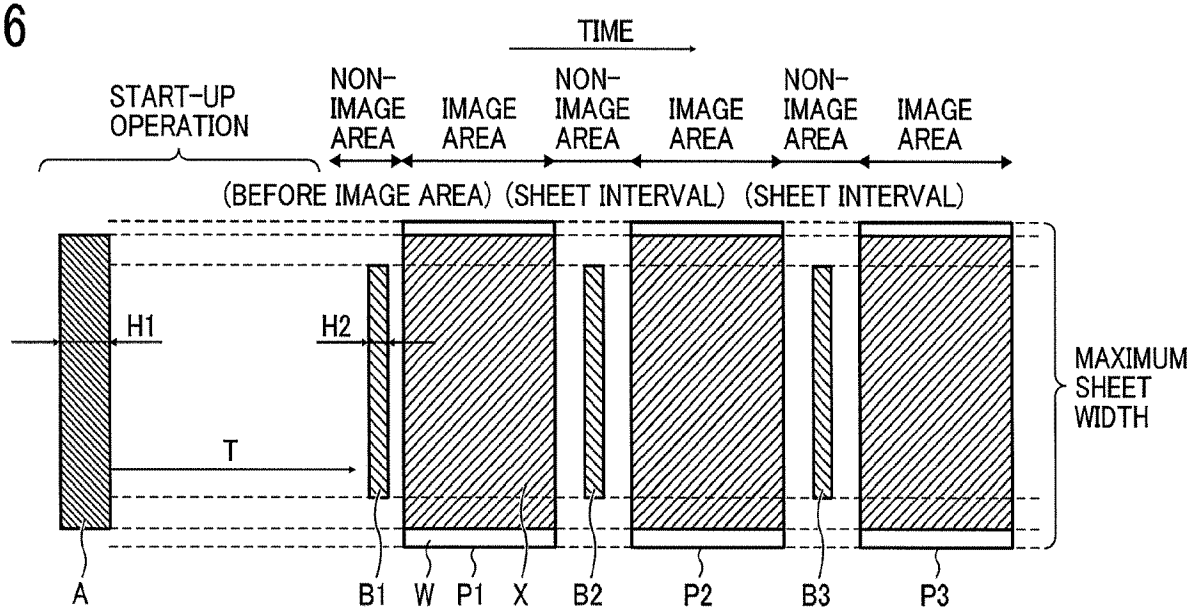
FIG. 6 is a diagram illustrating relative positions of toner pattern images transferred to the intermediate transfer belt and successive sheet feeding timing according to an embodiment of the present disclosure.

FIG. 6 illustrates an example of relative positions of the second toner pattern images B in successive image formation operations. The second toner pattern image B1 is formed at a timing corresponding to an area before the toner image X on a first recording sheet P1. The second toner pattern image B2 is formed at a timing corresponding to an interval area between the first recording sheet P1 and a second recording sheet P2 on which the toner images X are formed. The second toner pattern image B3 is formed at a timing corresponding to an interval area between the second recording sheet P2 and a third recording sheet P3 on which the toner images X are formed. As described above, the timing of formation of the second toner pattern images B1 to B3 is properly determined according to patterns of sheet feeding and image formation.

The image area is a range in a sub-scanning direction, and the toner image X to be transferred onto the recording sheet P is formed in the image area. The sub-scanning direction is perpendicular to the main-scanning direction and an identical to the direction of rotation of the intermediate transfer belt 8 and the photoconductor drums 1. The non-image area is ranges except the image area in the sub-scanning direction. The sub-scanning direction is the direction of conveyance of the recording sheet P. The main-scanning direction is perpendicular to the direction of conveyance of the recording sheet P, that is, the width direction. Therefore, the non-image area includes a range before and after the image area, a range corresponding to intervals between the recording sheets P in successive image formation, and an entire range in which the toner image X is not formed and the image forming units 6Y, 6M, 6C, and 6K is idled.

In addition to the second toner pattern images B (toner refreshment pattern) described above, the first toner pattern image A (dam formation pattern) is formed at the start-up before the image forming operation.

Specifically, at the start-up of the image forming apparatus 100 performed before the image forming operation for the toner image to be transferred to the recording sheet P, the first toner pattern images A are formed on the photoconductor drums 1 by the developing devices 5. The first toner pattern image A extends in a direction perpendicular to the direction of travel of the intermediate transfer belt 8 (top and bottom direction in FIGS. 6 and 7). In the present embodiment, the start-up of the image forming apparatus is performed when a main power supply is turned on, and includes preparations before the image forming operation (printing operation) onto the recording sheet P. The start-up after turning on the main power supply is independently performed irrespective of commands of image forming by the user. The start-up includes the start-up in a state in which the secondary-transfer cleaning blade 73 is new (unused), to be described later. The start-up includes a recovery operation performed after the jam is cleared. The first toner pattern image A is primarily transferred to the surface of the intermediate transfer belt 8 directly contacting the secondary transfer belt 72 without interposing the recording sheet P. Then, the first toner pattern image A is secondarily transferred onto the surface of the secondary transfer belt 72 in direct contact with the intermediate transfer belt 8 without interposing the recording sheet P. The first toner pattern image A on the secondary transfer belt 72 passes past the secondary-transfer cleaning blade 73 at least twice together with rotation of the secondary transfer belt 72. In the present embodiment, in the start-up, the rotation of the secondary transfer belt 72 is controlled so that the first toner pattern image A on the secondary transfer belt 72 passes past the secondary-transfer cleaning blade 73 more than or equal to eight times.

In other words, the first toner pattern image A that is approximately rectangular extending in the width direction is formed on the intermediate transfer belt 8 by the image forming process at the start-up of the image forming apparatus. Then, the first toner pattern image A is transferred to the secondary transfer belt 72 at the secondary transfer nip and input to the secondary-transfer cleaning blade 73. At that time, a time T from the formation of the first toner pattern image A to formation of a next toner image X is set long enough to allow the first toner pattern image A on the secondary transfer belt 72 to pass past the secondary-transfer cleaning blade 73 at least twice while the secondary transfer belt 72 rotates counterclockwise in FIG. 3. In the example in FIG. 6, the time T is length of a time from the formation of the first toner pattern image A to formation of the second toner pattern image B1 because the second toner pattern B1 is formed immediately before the next toner image X.

Therefore, the toner securely accumulates on an edge, which is the tip portion in sliding contact with the secondary transfer belt 72, of the secondary-transfer cleaning blade 73. This state is referred to as "dam formation state". According to repeated experiments, when the first toner pattern image A transferred to the secondary transfer belt 72 passes past the secondary-transfer cleaning blade 73 only once, the dam formation state is sufficiently maintained. However, a part of the first toner pattern image A slips through the edge of the secondary-transfer cleaning blade 73 in the process of forming the dam formation state, thereby causing a cleaning failure. Therefore, contamination of a backside of the recording sheet P, to be described later, occurs. By contrast, when the first toner pattern image A passes past the edge twice or more, the toner slipping through the edge is reliably removed and failure can be prevented.

As described above, the toner sufficiently accumulated on the edge of the secondary-transfer cleaning blade 73 functions as lubricant that reduces the sliding friction of the secondary-transfer cleaning blade 73 with respect to the secondary transfer belt 72. Therefore, problems that the edge of the secondary-transfer cleaning blade 73 is curled or broken due to increase in the sliding friction is alleviated, and the cleaning ability of the secondary-transfer cleaning blade 73 is favorably maintained.

Then, as described above with reference to FIG. 6, after the start-up is completed, at the timing of corresponding to the non-image area (during passage of the non-image area) different from the timing at which the toner image X is formed, the second toner pattern images B, which extend in the width direction, are formed on the photoconductor drums 1 by the developing devices 5. Then, the second toner pattern images B are primarily transferred onto the intermediate transfer belt 8 (image bearer). In other words, as the image forming operation starts after the start-up, the second toner pattern images B that have approximately a rectangular shape extending in the width direction is formed on the intermediate transfer belt 8 in the image forming process.

At the timing of the non-image area in which the second toner pattern images B are formed, the secondary transfer belt 72 directly contacts the intermediate transfer belt 8 without interposing the recording sheet P at the secondary transfer nip. Therefore, a part of the second toner pattern images B primarily transferred onto the surface of the intermediate transfer belt 8 is transferred to the surface of the secondary transfer belt 72 at the position of the secondary transfer nip and reaches the position of the secondary-transfer cleaning blade 73. At that time, as described above, the edge of the secondary-transfer cleaning blade 73 is in the dam formation state. Consequently, there is no problem that the second toner pattern images B is not completely removed by the secondary-transfer cleaning blade 73 and failure occurs. In addition, the backside, which is the front face when back surface printing is performed in the duplex print mode, of the recording sheet P transported to the secondary transfer nip is not contaminated due to failure of the secondary-transfer cleaning blade 73.

Referring to FIG. 7 (and FIG. 6), in the present embodiment, the first toner pattern image A is formed to have a range M1 wider than a range M2 of the second toner pattern images B in the width direction.

That is, the range M1 of the first toner pattern image A in the width direction is wider than the range M2 of the second toner pattern image B in the width direction.

Specifically, in the present embodiment, each first toner pattern image A is formed so that the range M1 (length in the main-scanning direction) has identical lengths from the center of a range M0 of the secondary-transfer cleaning blade 73 to both ends of the range M1 in width direction (hereinafter this relationship in the width direction is referred to as "formed based on center reference"). In the first toner pattern image A, the range M1 in the main-scanning direction (width direction) is 323 mm and a length H1 in the sub-scanning direction is 75 mm (or 20 mm). On the other hand, the second toner pattern image B is formed based on the center reference, the range M2 (length in the main-scanning direction) is 280 mm, the length H2 in the sub-scanning direction is variably set from 20 mm as a minimum value to a maximum value that is obtained by subtracting 30 mm from the interval between the recording sheets P. The length H2 in the sub-scanning direction is varied according to an amount of toner to be refreshed in the developing devices 5 calculated based on the number of recording sheets P on which the toner images X with a lower image area rate than the predetermined image area rate are continuously formed. Alternatively, the length H2 in the sub-scanning direction is varied according to the interval between recording sheets P.

That is, at the start-up, the controller 90 controls the image forming apparatus 100 to form the first toner pattern image A and drive the intermediate transfer belt 8 and the secondary transfer belt 72 as follows. Each developing device 5 forms the first toner pattern image A extending in the direction perpendicular to the direction of travel of the intermediate transfer belt 8 on the intermediate transfer belt 8. The first toner pattern image A is transferred to the secondary transfer belt 72. Then, the secondary transfer belt 72 rotates so that the first toner pattern image A passes past the secondary-transfer cleaning blade 73 at least twice.

Further, after the start-up is finished, the controller 90 controls the image forming apparatus 100 to form the second toner pattern image B and drive the intermediate transfer belt 8 and the secondary transfer belt 72 as follows. At the timing of the non-image area different from the timing at which the toner image X to be transferred to the recording sheets P is formed, the second toner pattern image B extending in the width direction are formed on the intermediate transfer belt 8 by the developing devices 5.

In such a manner, since the range M1 in the main-scanning direction of the first toner pattern image A is set to be sufficiently wide so as to include the range M2 of the second toner pattern images B in the main-scanning direction, the dam formation state by the first toner pattern image A is surely maintained in the range in the main-scanning direction of the secondary-transfer cleaning blade 73 to which the second toner pattern images B is input. Therefore, the second toner pattern images B is satisfactorily cleaned over the entire region in the main-scanning direction by the secondary-transfer cleaning blade 73.

It is to be noted that, in the present embodiment, an example is described in which the secondary transfer belt 72 directly contacts the intermediate transfer belt 8 whenever the second toner pattern images B pass through a secondary transfer position. However, the contact between the secondary transfer belt 72 and the intermediate transfer belt 8 is not limited to this configuration. For example, when some or all of the second toner pattern images B pass through the secondary transfer position, the secondary transfer belt 72 may separate from the intermediate transfer belt 8 as illustrated in FIG. 4B. Also in such a configuration, in the secondary transfer position, a part of the toner constituting the second toner pattern images B is scattered to the secondary transfer belt 72 and adheres to the surface of the secondary transfer belt 72. Also in this case, since the range M1 in the width direction of the first toner pattern image A is set sufficiently wide so as to include the range M2 in the width direction of the second toner pattern images B, the dam formation state by the first toner pattern image A is surely maintained in the range in the width direction of the secondary-transfer cleaning blade 73 to which the second toner pattern images B are input. Therefore, the second toner pattern images B are satisfactorily cleaned over the entire region in the width direction by the secondary-transfer cleaning blade 73.

Further, in the present embodiment, the first toner pattern image A is formed so that the range M1 in the width direction is approximately equal to a maximum image range.

Here, the maximum image range is the maximum area in the width direction in which the electrostatic latent image can be formed on the photoconductor drums 1 by the exposure device 7 and in which the electrostatic latent image can be visualized by the developing devices 5. The maximum image range is also referred to as "maximum writing area". Referring to FIG. 6, the maximum image range is a range in which a margins W at both ends is subtracted from the range (maximum sheet width) in the width direction of the maximum size recording media P1 to P3 that can be fed.

In such a manner, by setting the range M1 in the width direction of the first toner pattern image A as wide as possible in accordance with the maximum image range, the range M1 is be wider than the range M2 of the second toner pattern images B. Therefore, the second toner pattern images B are completely removed by the secondary-transfer cleaning blade 73, and failure does not occur.

Further, in the present embodiment, the first toner pattern image A is formed so that the range M1 in the width direction is narrower than the range M0 in the width direction of the secondary-transfer cleaning blade 73.

Specifically, in the present embodiment, the secondary-transfer cleaning blade 73 (blade body 73*a*) is formed based on center reference, and the length M0 in the width direction is 341 mm. Also, in the width direction of the secondary-transfer cleaning blade 73, both end portions of the range M0 out of the range M1 in the width direction of the first toner pattern image A is larger than the margin W of the maximum sheet width (330 mm in the present embodiment).

Thus, the range M0 in the width direction of the secondary-transfer cleaning blade 73 is widened because the both end portions of the secondary-transfer cleaning blade 73 tend to curl and have low cleaning ability compared to other portions of the secondary-transfer cleaning blade 73. That is, if the range M0 in the width direction of the secondary-transfer cleaning blade 73 is same as the range M1 in the width direction of the first toner pattern image A, the first toner pattern image A may not be completely cleaned in the both end portions of the secondary-transfer cleaning blade 73. Accordingly, the uncleaned toner may adhere to the margin W or the vicinity thereof as the contamination of the backside of the recording sheet P to be subsequently fed.

On the other hand, in the present embodiment, since the first toner pattern image A is set not to be input to the both end portions of the secondary-transfer cleaning blade 73, the contamination of the backside of the recording sheet P in the both end portions in the width direction of the recording sheet P can be prevented.

In the present embodiment, the range in the width direction of the secondary transfer belt 72 is same as the range M0 in the width direction of the secondary-transfer cleaning blade 73 described above.

Furthermore, in the present embodiment, contact pressure of the secondary-transfer cleaning blade 73 with respect to the secondary transfer belt 72 (transfer rotator) in the both end portions in the width direction is lower than the contact pressure of the other portion with respect to the secondary transfer belt 72.

Specifically, in the present embodiment, as illustrated in FIG. 7, a stepped portion (which is a portion surrounded by a broken line in FIG. 7) is formed in the both end portions of the blade holder 73*b*, which holds the blade body 73*a* by cantilever support. As a result, the blade body 73*a* is cantilevered by the blade holder 73*b* in a state in which a free length in the both end portions is longer than that of the other portions. Therefore, the contact pressure of the secondary-transfer cleaning blade 73 with respect to the secondary transfer belt 72 becomes lower in the both end portions than at the other portions, and the both end portions of the secondary-transfer cleaning blade 73 tend not to be curled as described earlier. In the present embodiment, since the range (range M1) other than the both end portions which contacts at the normal contact pressure in the secondary-transfer cleaning blade 73 is same as the maximum image range, both failure and blade curl can be prevented.

Further, during the start-up, the secondary transfer bias having a negative polarity is applied from the power source 91 to the secondary-transfer backup roller 80 at least when the first toner pattern image A passes past the secondary transfer nip in the present embodiment, in order to ensure that the first toner pattern image A formed on the intermediate transfer belt 8 is transferred onto the secondary transfer belt 72 at the position of the secondary transfer nip. In the present embodiment, when the first toner pattern image A passes the position of the secondary transfer nip, the power source 91 outputs the secondary transfer bias of −1.6 kV to the secondary-transfer backup roller 80. As a result, similarly to the ordinary secondary transfer process, as an electrostatic repulsive force acts on the first toner pattern image A on the intermediate transfer belt 8, the first toner pattern image A is actively transferred to the secondary transfer belt 72. Then, the first toner pattern image A is actively supplied to the nip portion of the secondary-transfer cleaning blade 73.

On the other hand, as described above, since the second toner pattern image B formed on the non-image area on the intermediate transfer belt 8 causes failure of the secondary-transfer cleaning blade 73, it is preferable that the second toner pattern image B is not transferred to the secondary transfer belt 72 as much as possible in the secondary transfer nip. Therefore, a bias having a plus polarity is applied from the power source 91 to the secondary-transfer backup roller 80 at the timing of the non-image area where the second toner pattern image B passes past the secondary transfer nip.

In the present embodiment, when the second toner pattern image B passes past the secondary transfer nip, the power source 91 outputs the secondary transfer bias of +0.5 kV to the secondary-transfer backup roller 80. Therefore, as an electrostatic attraction force acts on the second toner pattern image B formed on the intermediate transfer belt 8 unlike the ordinary secondary transfer process, the second toner pattern image B is tends to stay on the intermediate transfer belt 8. However, a part of the toner constituting the second toner pattern image B is transferred to the secondary transfer belt 72 at the secondary transfer position due to the contact between the intermediate transfer belt 8 and the secondary transfer belt 72 or vibration during the rotation of the intermediate transfer belt 8, and adheres to the secondary transfer belt 72. Note that when the second toner pattern image B passes past the secondary transfer nip, the secondary transfer bias output from the power source 91 may be 0 kV. In this case, since the input amount of the second toner pattern image B to the secondary-transfer cleaning blade 73 is smaller than that of the first toner pattern image A, failure of the secondary-transfer cleaning blade 73 can be prevented. Furthermore, when the second toner pattern images B passes past the secondary transfer nip, a bias of minus polarity may be output from the power source 91. In this case, it is preferable that the secondary transfer bias output from the power source 91 has a smaller absolute value than the bias (−1.6 kV in the present embodiment) output when the first toner pattern image A passes past the secondary transfer nip. Also in this case, since the input amount of the second toner pattern image B to the secondary-transfer cleaning blade 73 is smaller than that of the first toner pattern image A, it is possible to prevent failure of the secondary-transfer cleaning blade 73.

In the present embodiment, as described above, the timing of formation of the second toner pattern images B is determined according to the image area rate and frequency of formation of the toner image X in the image area. Then, such formation of the second toner pattern images B is executed according to a determination for each of four colors.

Therefore, when only one of the developing devices 5Y, 5M, 5C, and 5K for four colors (only the developing device 5K for black, for example) is under the condition for refreshing toner, the second toner pattern image B is formed on the corresponding photoconductor drum 1K, and the second toner pattern image B is primarily transferred to the intermediate transfer belt 8. On the other hand, when all of the developing devices 5Y, 5M, 5C, and 5K for the four colors are under the condition for refreshing toner, the four developing devices 5Y, 5M, 5C, and 5K develop the second toner pattern images B on the respective photoconductor drums 1Y, 1M, 1C, and 1K, and the second toner pattern images B are primarily transferred and superimposed onto the intermediate transfer belt 8.

Here, in the present embodiment, even when the second toner pattern image B with any color is formed, the second toner pattern image B is set to be a halftone image (image area rate is about 56%). Therefore, when the second toner pattern images B of four colors are formed and superimposed one on another on the intermediate transfer belt 8, the image area rate of the second toner pattern image B is 224% (=56%×4).

Here, in the present embodiment, toner adhesion amount per unit area of the first toner pattern image A is preferably equal to or greater than toner adhesion amount per unit area of the second toner pattern image B. Note that, the toner adhesion amount per unit area is defined on the secondary transfer belt 72. If a transfer rate at the secondary transfer nip is constant, the toner adhesion amount per unit area is approximately proportional to the image area rate described above.

With this configuration, the amount of toner that is input to the edge of the secondary-transfer cleaning blade 73 and is formed into the dam formation state is greater than the amount of toner of the second toner pattern image B that is input to the edge of the secondary-transfer cleaning blade 73. Therefore, the cleaning ability of the secondary-transfer cleaning blade 73 is favorably maintained.

Here, in the present embodiment, when the start-up is performed with the secondary-transfer cleaning blade 73 being new, the first toner pattern images A are formed on the plurality of photoconductor drums 1Y, 1M, 1C, and 1K by the plurality of developing devices 5Y, 5M, 5C, and 5K respectively, and primarily transferred and superimposed onto the surface of the intermediate transfer belt 8. That is, when the secondary transfer device 700 are in a new state or the secondary-transfer cleaning blade 73 is in a new state after maintenance, at the start-up performed immediately thereafter, four color toner images formed on the four color photoconductor drums 1Y, 1M, 1C, and 1K by the four color developing devices 5Y, 5M, 5C, and 5K are primarily transferred and superimposed onto the intermediate transfer belt 8 to form the first toner pattern image A.

When the secondary-transfer cleaning blade 73 is in the new state, there is no toner functioning as lubricant at the edge of the secondary-transfer cleaning blade 73. Accordingly, the above-described control that forms the first toner pattern image A is performed in order to input a large amount of toner to the edge of the secondary-transfer cleaning blade 73.

In the present embodiment, when the secondary-transfer cleaning blade 73 is in the new state, the first toner pattern image A using four colors is input to the edge of the secondary-transfer cleaning blade 73. Therefore, even in the new state, failure of the secondary-transfer cleaning blade 73 can be minimized.

It is possible for the controller 90 to determine whether the secondary-transfer cleaning blade 73 is in a new state based on information input to the control panel 92 by a service engineer.

Further, in the present embodiment, even when the first toner pattern image A is formed with any color, the first toner pattern image A has a length H1 in the sub-scanning direction of about 75 mm and is the halftone image whose image area rate is about 56%. Therefore, when the first toner pattern image A using four colors is formed on the intermediate transfer belt 8, the image area rate is 224% (=56%×4).

Furthermore, in the present embodiment, when the start-up is performed as the recovery operation after the jam is cleared, the first toner pattern image A is formed on one (in the present embodiment, the black photoconductor drum 1K) of the plurality of photoconductor drums 1Y, 1M, 1C, and 1K by one (in the present embodiment, the black developing device 5K) of the plurality of developing devices 5Y, 5M, 5C, and 5K, and primarily transferred onto the surface of the intermediate transfer belt 8.

As described above with reference to FIGS. 4A, 4B, 5A, and 5B, when the jam is cleared, a contact-separation operation of the secondary transfer device 700 is performed as the drawer unit 120 is inserted into the image forming apparatus 100. Accordingly, toner remaining at the edge of the secondary-transfer cleaning blade 73 tends to be separated due to the vibration occurring at that time. However, at the start-up immediately after the jam is cleared, the toner functioning as the lubricant remains at the edge of the secondary-transfer cleaning blade 73 to a certain extent, unlike when the secondary-transfer cleaning blade 73 is in the new state. Therefore, it is not necessary to input a large amount of toner, and the first toner pattern image A is formed in one color and the image area rate is set low.

In the present embodiment, at the start-up immediately after the jam is cleared, the first toner pattern image A using one color is input to the edge of the secondary-transfer cleaning blade 73. Therefore, wasted toner consumption is minimized, and failure of the secondary-transfer cleaning blade 73 can be minimized.

The state in which the jam is cleared can be discriminated by the controller 90 based on the detection result by a plurality of jam detectors 93 (optical sensors) disposed in the conveyance paths K1 to K4 of the recording sheet P.

Further, in the present embodiment, when first toner pattern image A is formed with one color, the first toner pattern image A has a length H1 in the sub-scanning direction of about 20 mm and is a solid image whose image area rate is about 100%.

Furthermore, in the present embodiment, when the start-up is performed after the main power supply of the image forming apparatus 100 is turned on, the first toner pattern image A is formed on one (in the present embodiment, the black photoconductor drum 1K) of the plurality of photoconductor drums 1Y, 1M, 1C, and 1K by corresponding one (in the present embodiment, the black developing device 5K) of the plurality of developing devices 5Y, 5M, 5C, and 5K, and primarily transferred onto the surface of the intermediate transfer belt 8.

Such a control is performed because the image forming apparatus 100 may be moved or the maintenance of the secondary transfer device 700 is performed while the main power supply is off. Accordingly, toner remaining at the edge of the secondary-transfer cleaning blade 73 may be separated due to the vibration occurring at that time. However, even if toner remaining at the edge of the secondary-transfer cleaning blade 73 is separated, at the start-up immediately after the main power supply of the image forming apparatus 100 is turned on, the toner functioning as the lubricant remains at the edge of the secondary-transfer cleaning blade 73 to a certain extent, unlike when the secondary-transfer cleaning blade 73 is in the new state. Therefore, it is not necessary to input a large amount of toner, and the first toner pattern image A is formed in one color and the image area rate is set low.

In the present embodiment, at the start-up immediately after the main power supply is turned on, the first toner pattern image A using one color is input to the edge of the secondary-transfer cleaning blade 73. Therefore, wasted toner consumption is suppressed, and failure of the secondary-transfer cleaning blade 73 can be minimized.

Figure 8:
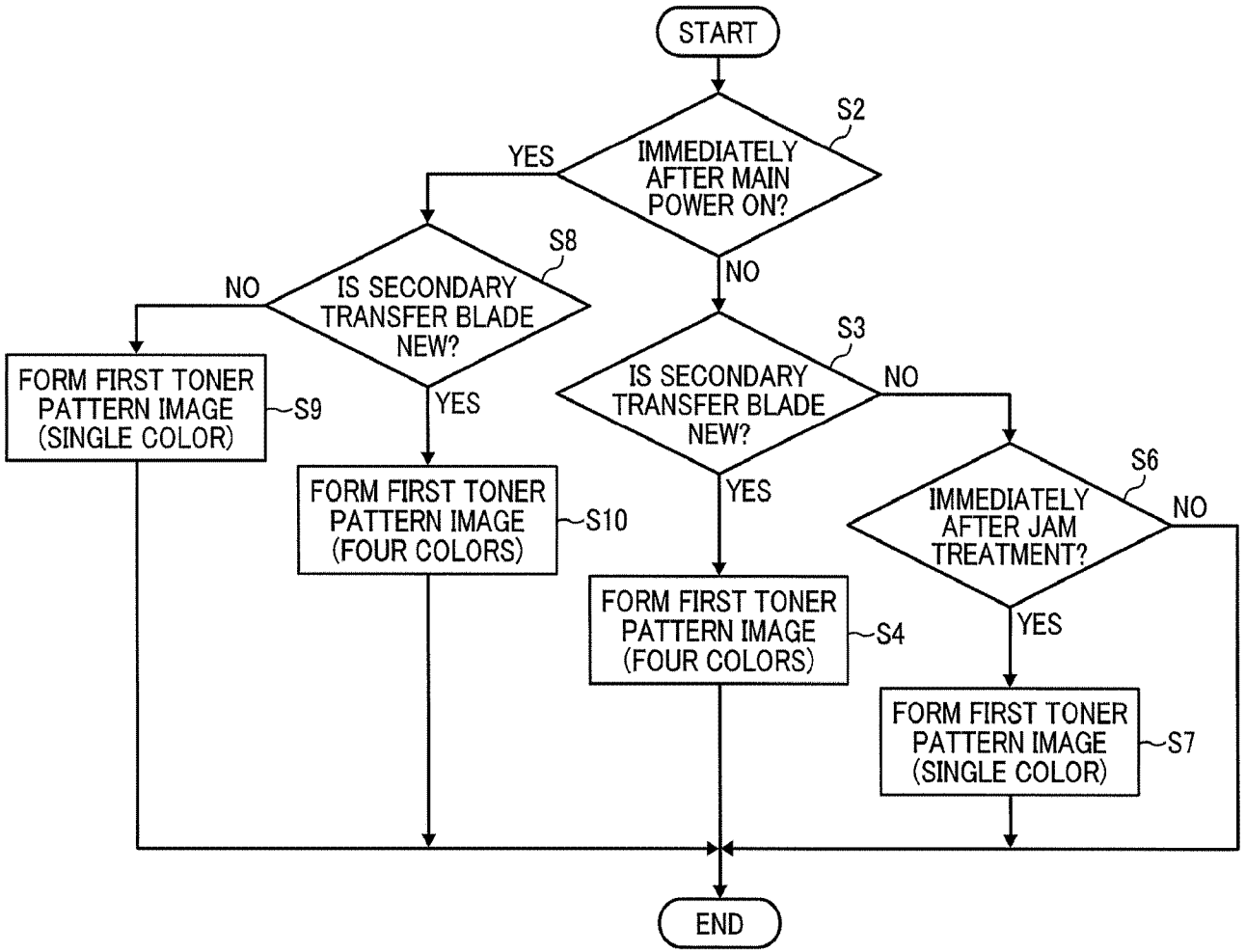
FIG. 8 is a flowchart of control at start-up of the image forming apparatus according to an embodiment of the present disclosure.

Referring to FIG. 8, descriptions are given below of a control process during the start-up in the image forming apparatus 100 according to the present embodiment. In the control process, the controller 90 determines whether the first toner pattern image A is to be formed in four colors or one color.

As illustrated in FIG. 8, first, the controller 90 determines whether the main power supply has just turned on (steps S1 and S2). If the controller 90 determines that the main power supply has not been just turned on, the controller 90 determines whether the secondary-transfer cleaning blade 73 is new (step S3). As described above, the controller 90 can determine whether the secondary-transfer cleaning blade 73 is in a new state based on information input to the control panel 92 by a service engineer. If it is determined that the secondary-transfer cleaning blade 73 is new, the controller 90 determines that failure of the secondary-transfer cleaning blade 73 is most likely to occur in that state. Therefore, at the start-up performed immediately thereafter, the controller 90 determines to form the first toner pattern image A in four colors (step S4), and the current process ends (step S5).

On the other hand, if it is determined in step S3 that the secondary-transfer cleaning blade 73 is not new, the controller 90 determines whether it is immediately after the jam is cleared (step S6). If it is determined that it is immediately after the jam is cleared, the controller 90 determines that failure of the secondary-transfer cleaning blade 73 is likely to occur in that state but is not so likely to occur as when the secondary-transfer cleaning blade 73 is new. Therefore, the controller 90 determines to form the first toner pattern image A in one color at the start-up performed immediately thereafter (step S7), and the current process ends (step S5).

On the other hand, if it is determined in step S6 that it is not immediately after the jam is cleared, the controller 90 determines that failure of the secondary-transfer cleaning blade 73 is unlikely to occur in that state. Therefore, the controller 90 determines not to form the first toner pattern image A, and the current process ends (step S5).

On the other hand, if the controller 90 determines in step S2 that the main power supply has just been turned on, the controller 90 determines whether the secondary-transfer cleaning blade 73 is new (step S8). If it is determined that the secondary-transfer cleaning blade 73 is new, the controller 90 determines that failure of the secondary-transfer cleaning blade 73 is most likely to occur in that state. Therefore, at the start-up performed immediately thereafter, the controller 90 determines to form the first toner pattern image A in four colors (step S10), and the current process ends (step 5).

On the other hand, if it is determined that the secondary-transfer cleaning blade 73 is not new in step 8, the controller 90 determines that failure of the secondary-transfer cleaning blade 73 is likely to occur in that state but is not so likely to occur as when the secondary-transfer cleaning blade 73 is new. Therefore, the controller 90 determines to form the first toner pattern image A in one color at the start-up performed immediately thereafter (step S9), and the current process ends (step S5).

Descriptions are given below of a modification of the above-described embodiment.

Figure 9:
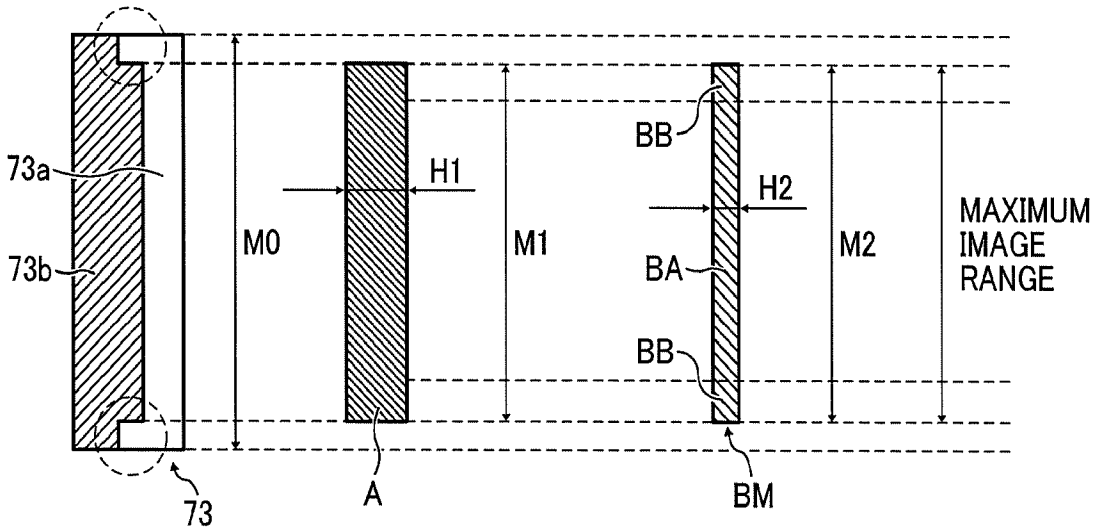
FIG. 9 is a diagram illustrating the relative positions in the width direction of a second transfer blade, a first toner pattern image, and a second toner pattern image according to a modification.

FIG. 9 is a diagram illustrating the relative positions in the width direction (main-scanning direction) of a secondary-transfer cleaning blade 73, a first toner pattern image A, and a second toner pattern image BM according to the modification of the above-described embodiment. FIG. 9 according to the modification corresponds to FIG. 7 of the above-described embodiment.

As illustrated in FIG. 9, in the modification, the first toner pattern image A is formed to have the range M1 approximately as wide as the range M2 of the second toner pattern image BM in the width direction. That is, the range M1 of the first toner pattern image A in the width direction is approximately as wide as than the range M2 of the second toner pattern image BM in the width direction.

In addition, the second toner pattern image BM is formed such that the image density of both end portions BB in the width direction is lower than the image density of the other portion BA (i.e., areas of reduce image density). Specifically, in the present modification, the exposure device 7 is controlled to form the second toner pattern image BM so that the image area rate of the both end portions BB is lower than the image area rate of the other portion BA.

With this configuration, even if the range M1 in the width direction of the first toner pattern image A is approximately the same range as the range M2 in the width direction of the second toner pattern image BM, the toner amount of the second toner pattern image BM input to the both end portions of the secondary-transfer cleaning blade 73 becomes small, so that it is possible to satisfactorily clean the second toner pattern image BM by the secondary-transfer cleaning blade 73 in the dam formation state formed by inputting the first toner pattern image A. Therefore, preferable cleaning ability can be secured over the entire region in the width direction by the secondary-transfer cleaning blade 73.

As described above, the image forming apparatus 100 according to the present embodiment is controlled as follows. At the start-up, the first toner pattern image A is transferred via the intermediate transfer belt 8 (image bearer) to the secondary transfer belt 72 (transfer rotator). Then, the first toner pattern image A on the secondary transfer belt 72 passes past the secondary-transfer cleaning blade 73 (blade) at least twice. After the start-up ends, the second toner pattern images B1 to B3 are formed at the timing of the non-image area. The range M1 of the first toner pattern image A in the width direction is wider than the range M2 of the second toner pattern images B1 to B3 in the width direction.

As a result, the image failure due to degradation of toner hardly occurs even over time, and it is possible to prevent failure by the secondary-transfer cleaning blade 73.

In the present embodiment, the power source 91 is configured to apply the secondary transfer bias (image area bias) and the non-image area bias (bias applied in the non-image area) to the secondary-transfer backup roller 80. That is, the present disclosure is applied to the image forming apparatus 100 of a repulsive force transfer type. On the other hand, the present disclosure can be applied to an image forming apparatus 100 of an attraction transfer type in which the power source is configured to apply the secondary transfer bias (image area bias) and the non-image area bias to the secondary transfer roller 70. In this case, the secondary transfer bias (image area bias) and the non-image area bias are opposite in polarity to those of the repulsive force transfer type. Further, the present disclosure can also be applied to an image forming apparatus in which the repulsive force transfer type and the attraction transfer type are used in combination.

Additionally, the present disclosure is applied to the image forming apparatus 100 employing the secondary transfer belt 72 as the transfer rotator. On the other hand, the present disclosure can also be applied to an image forming apparatus employing a secondary transfer roller as the transfer rotator.

Additionally, the present disclosure is applied to the image forming apparatus 100 employing the intermediate transfer belt 8 (intermediate transferor) and the secondary transfer belt 72 as the transfer rotator. On the other hand, the present disclosure can also be applied to an image forming apparatus of so-called direct transfer type. The image forming apparatus of the direct transfer type does not include an intermediate transferor such as an intermediate transfer belt or an intermediate transfer drum, and includes a developing device for developing the toner, a photoconductor drum as an image bearer on which a toner image is developed by the developing device, and a transfer rotator that is in contact with the photoconductor drum to form a transfer nip and transfers the toner image on the photoconductor drum to the recording medium transported to the transfer nip. As the transfer rotator, a conveyance belt supported by a plurality of rollers can be used.

Further, in the present embodiment, the present disclosure is applied to the image forming apparatus 100 that forms the color image. On the other hand, the present disclosure can also be applied to an image forming apparatus that forms only a monochrome image.

In such configurations, effects similar to those described above are also attained.

In addition, when the start-up is performed in the state in which the secondary-transfer cleaning blade 73 is new, the first toner pattern image can be formed using only toner of one color, two colors, or three colors instead of the four color toner. Further, when the start-up is performed after the jam is cleared, the first toner pattern image may be formed using toner of two or more colors. Further, in the present embodiment, the first toner pattern image A and the second toner pattern image B are single belt-like pattern images extending continuously in the belt width direction. This is because a single pattern image can be formed in a shorter time than when forming a plurality of pattern images. However, the first toner pattern image A and the second toner pattern image B are not necessarily single. For example, one of the first toner pattern images A is firstly formed at center in the width direction of the secondary transfer belt 72 at the start-up. Subsequently, other first toner pattern image A may be formed at the end portion in the width direction of the secondary transfer belt 72 (area except the center on the secondary transfer belt 72). Further, the first toner pattern image A may be formed at an angle to the direction of travel and the width direction of the secondary transfer belt 72.

Numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. An image forming apparatus comprising:

at least one developing device to develop an electrostatic latent image to form a toner image;

an image bearer to bear the toner image formed by the at least one developing device;

a transfer rotator to transfer the toner image onto a recording medium at a transfer nip that is formed between the image bearer and the transfer rotator;

a blade contacting a surface of the transfer rotator; and a controller to control the at least one developing device, the image bearer, and the transfer rotator to:

form a first toner pattern image on the image bearer, transfer the first toner pattern image onto the transfer rotator, and pass the first toner pattern image past the blade at least twice with rotation of the transfer rotator at start-up of the image forming apparatus, and form a second toner pattern image on the image bearer after the start-up and during passage of a non-image area in which the toner image is not formed on the image bearer, a range of the first toner pattern image being wider than a range of the second toner pattern image in a width direction perpendicular to a direction of travel of the image bearer.

2. The image forming apparatus according to claim 1, wherein the range of the first toner pattern image is equal to a maximum image range of the image forming apparatus in the width direction.

3. The image forming apparatus according to claim 1, wherein the range of the first toner pattern image is narrower than the blade in the width direction.

4. The image forming apparatus according to claim 1, wherein a toner adhesion amount per unit area of the first toner pattern image is greater than or equal to a toner adhesion amount per unit area of the second toner pattern image.

5. The image forming apparatus according to claim 1, wherein a contact pressure of the blade against the transfer rotator at both end portions of the blade in the width direction is weaker than a contact pressure of the blade against the transfer rotator at a portion of the blade other than the both end portions of the blade.

6. The image forming apparatus according to claim 1, further comprising a plurality of photoconductors, wherein the at least one developing device includes a plurality of developing devices to form toner images on respective surfaces of the plurality of photoconductors, and wherein the image bearer is an intermediate transfer belt to which the toner images on the surfaces of the plurality of photoconductors are primarily transferred.

7. The image forming apparatus according to claim 6, wherein the first toner pattern image is formed on each of the plurality of photoconductors by the plurality of developing devices, primarily transferred, and superimposed one on another onto a surface of the intermediate transfer belt when the start-up is performed in a state where the blade is new.

8. The image forming apparatus according to claim 6, wherein the first toner pattern image is formed on a corresponding one the plurality of photoconductors by one of the plurality of developing devices and primarily transferred to a surface of the intermediate transfer belt when the start-up is performed after a recording medium jam is cleared.

9. The image forming apparatus according to claim 6, wherein the first toner pattern image is formed on a corresponding one of the plurality of photoconductors by one of the plurality of developing devices and primarily transferred to the surface of the intermediate transfer belt when the start-up is performed after the image forming apparatus is turned on.

10. The image forming apparatus according to claim 6, wherein the transfer rotator is a secondary transfer belt stretched taut around a plurality of rollers including a secondary transfer roller, wherein the intermediate transfer belt is stretched taut around a plurality of rollers including a secondary-transfer backup roller, wherein the secondary transfer roller and the secondary-transfer backup roller squeeze the intermediate transfer belt and the secondary transfer belt to form a. secondary transfer nip as the transfer nip, and wherein the blade presses against the secondary transfer roller via the secondary transfer belt against a direction of rotation of the secondary transfer belt.

11. An image forming apparatus comprising:

at least one developing device to develop an electrostatic latent image to form a toner image:

an image bearer to bear the toner image formed by the at least one developing device;

a transfer rotator to transfer the toner image onto, a recording medium at a transfer nip that is formed between the image bearer and the transfer rotator;

a blade contacting a surface of the transfer rotator; and a controller to control the at least one developing, device, the image bearer, and the transfer rotator to:

form a first toner pattern image on the image bearer, transfer the first toner pattern image onto the transfer rotator, and pass the first toner pattern image past the blade at least twice with rotation of the transfer rotator at start-up of the image forming apparatus, and form a second toner pattern image on the image bearer after the start-up and during passage of a non-image area in which the toner image is not formed on the image bearer, a range of the first toner pattern image being equal to a range of the second toner pattern image in a width direction perpendicular to a direction of travel of the image bearer, both end portions of the second toner pattern image in the width direction having an image density lower than an image density of a portion of the second toner pattern image other than the both end portions.

12. The image forming apparatus according to claim 11, wherein the range of the first toner pattern image is equal to a maximum image range of the image forming apparatus in the width direction.

13. The image forming apparatus according to claim 11, wherein the range of the first toner pattern image is narrower than the blade in the width direction.

14. The image forming apparatus according to claim 11, wherein a toner adhesion amount per unit area of the first toner pattern image is greater than or equal to a toner adhesion amount per unit area of the second toner pattern image.

15. The image forming apparatus according to claim 11, wherein a contact pressure of the blade against the transfer rotator at both end portions of the blade in the width direction is weaker than a contact pressure of the blade against the transfer rotator at a portion of the blade other than the both end portions of the blade.

16. The image forming apparatus according to claim 11 further comprising a plurality of photoconductors, wherein the at least one developing device includes a plurality of developing devices to form toner images on respective surfaces of the plurality of photoconductors, and, wherein the image bearer is an intermediate transfer belt to which the toner images on the surfaces of the plurality of photoconductors are primarily transferred.

17. The image forming apparatus according to claim 16, wherein the first toner pattern image is formed on each of the plurality of photoconductors by the plurality of developing devices, primarily transferred, and superimposed one on another onto a surface of the intermediate transfer belt when the start-up is performed in a state where the blade is new.

18. The image forming apparatus according to claim 16, wherein the first toner pattern image is formed on a corresponding one of the plurality of photoconductors by one of the plurality of developing devices and primarily transferred to a surface of the intermediate transfer belt when the start-up is performed after a recording medium jam is cleared.

19. The image forming apparatus according to claim 16, wherein the first toner pattern image is formed on a corresponding one of the plurality of photoconductors by one of the plurality of developing devices and primarily transferred to a surface of the intermediate transfer belt when the start-up is performed after the image forming apparatus is turned on.

20. The image forming apparatus according to claim 16, wherein the transfer rotator is a secondary transfer belt stretched taut around a plurality of rollers including a secondary transfer roller, wherein the intermediate transfer belt is stretched taut around a plurality of rollers including a secondary-transfer backup roller, wherein the secondary transfer roller and the secondary-transfer backup roller squeeze the intermediate transfer belt and the secondary transfer belt to form a secondary transfer nip as the transfer nip, and wherein the blade presses against the secondary transfer roller via the secondary transfer belt against a direction of rotation of the secondary transfer belt.

* * * * *